US009915064B1

(12) United States Patent
Sanders et al.

(10) Patent No.: US 9,915,064 B1
(45) Date of Patent: Mar. 13, 2018

(54) METHOD AND APPARATUS FOR REDUCING PROPAGATION OF CRACKS IN CONCRETE

(71) Applicants: Mark E. Sanders, Zionsville, IN (US); Jeffrey L. Roberts, Plainfield, IN (US)

(72) Inventors: Mark E. Sanders, Zionsville, IN (US); Jeffrey L. Roberts, Plainfield, IN (US)

( * ) Notice: Subject to any disclaimer, the term of this patent is extended or adjusted under 35 U.S.C. 154(b) by 0 days.

(21) Appl. No.: 15/349,022

(22) Filed: Nov. 11, 2016

(51) Int. Cl.

| | |
|---|---|
| ***E04B 1/68*** | (2006.01) |
| ***E04F 15/14*** | (2006.01) |
| ***E04B 1/686*** | (2006.01) |
| ***E02D 27/01*** | (2006.01) |
| ***E02D 27/08*** | (2006.01) |
| ***E02D 31/10*** | (2006.01) |
| ***E04G 15/06*** | (2006.01) |
| ***E04G 17/02*** | (2006.01) |

(52) U.S. Cl.
CPC ..... *E04B 1/6807* (2013.01); *E02D 27/013* (2013.01); *E02D 27/08* (2013.01); *E02D 31/10* (2013.01); *E04G 15/061* (2013.01); *E04G 17/02* (2013.01)

(58) Field of Classification Search
CPC .... E04B 1/6807; E04B 1/41; E04B 2005/324; E04B 5/43; E04B 5/40; E02D 27/013; E02D 27/08; E02D 31/10; E04G 15/061; E04G 17/02; E04G 13/021; E04G 17/00; E04G 13/02; B28B 7/0064
USPC ..... 52/396.02
See application file for complete search history.

(56) References Cited

U.S. PATENT DOCUMENTS

| | | | | |
|---|---|---|---|---|
| 3,254,463 A | | 6/1966 | Mosely | |
| 3,291,437 A | * | 12/1966 | Bowden | E04G 13/021 220/4.11 |
| 3,588,027 A | * | 6/1971 | Bowden | E04G 13/021 220/4.28 |
| 3,682,434 A | * | 8/1972 | Boenig | E04G 17/00 138/162 |
| 4,083,526 A | * | 4/1978 | Hatfield | B28B 7/34 249/115 |

(Continued)

FOREIGN PATENT DOCUMENTS

KR 200305364 3/2003

OTHER PUBLICATIONS

International Search Report corresponding to international application No. PCT/US2017/033223, dated Aug. 14, 2017, 8 pages.

*Primary Examiner* — Brian D Mattei
(74) *Attorney, Agent, or Firm* — Maginot, Moore & Beck LLP

(57) ABSTRACT

An apparatus for reducing propagation of cracks in concrete includes a curved panel. The curved panel includes a convex surface and a concave surface facing away from one another and separated by a thickness. Each of the convex and concave surfaces has a top edge, a bottom edge, a first end, and a second end. Each of the convex and concave surfaces is configured to be arranged in direct contact with the concrete. The curved panel further includes a top surface extending between the top edges of the convex and concave surfaces. The top surface is substantially planar and substantially perpendicular to the convex and concave surfaces. The curved panel further includes a bottom surface extending between the bottom edges of the convex and concave surfaces. The bottom surface is substantially planar and substantially parallel to the top surface.

9 Claims, 14 Drawing Sheets

(56) References Cited

U.S. PATENT DOCUMENTS

| | | | | | |
|---|---|---|---|---|---|
| 4,125,394 | A * | 11/1978 | Wilson | C05F 17/0205 | 422/400 |
| 4,598,517 | A * | 7/1986 | Alvarsson | B28B 7/0035 | 52/250 |
| 4,916,800 | A * | 4/1990 | Harbeke | E04G 15/061 | 29/469 |
| 5,103,609 | A * | 4/1992 | Thoreson | A62C 2/065 | 52/232 |
| 5,743,065 | A | 4/1998 | Crews et al. | | |
| 5,857,302 | A | 1/1999 | Lill | | |
| 6,357,172 | B1 * | 3/2002 | Risgaard | A01G 13/10 | 47/32.4 |
| 8,726,600 | B1 | 5/2014 | Schmitz | | |
| 2004/0128922 | A1 * | 7/2004 | Fearn | E04G 13/021 | 52/169.13 |
| 2009/0232606 | A1 * | 9/2009 | Penza | E04G 13/021 | 405/257 |
| 2010/0223882 | A1 * | 9/2010 | Parenti | E04C 3/36 | 52/834 |
| 2011/0062307 | A1 * | 3/2011 | Currier | E04B 5/40 | 249/1 |
| 2012/0085886 | A1 * | 4/2012 | Xie | E04G 15/061 | 249/96 |
| 2014/0312529 | A1 * | 10/2014 | Manthei | B29C 39/10 | 264/263 |
| 2017/0101760 | A1 * | 4/2017 | Seay | E02D 27/42 | |

* cited by examiner

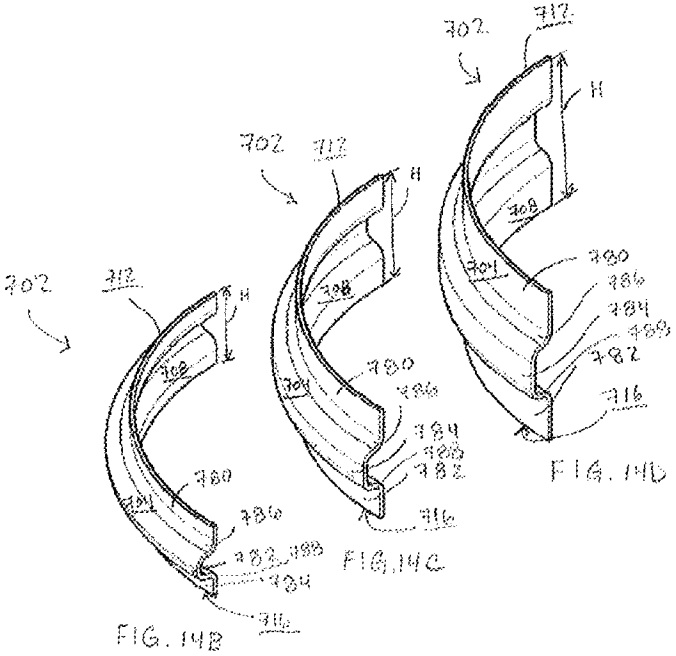
FIG. 14B
FIG. 14C
FIG. 14D
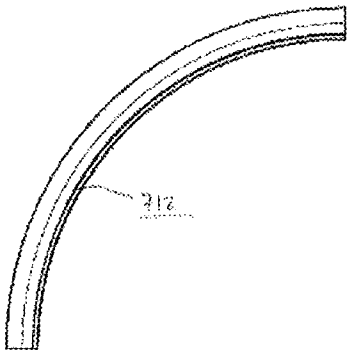
FIG. 14A

METHOD AND APPARATUS FOR REDUCING PROPAGATION OF CRACKS IN CONCRETE

BACKGROUND

The present disclosure relates to poured concrete slabs, such as poured concrete slabs for buildings.

A foundation of a building connects the building to the ground, transfers loads from the building to the ground, and provides structural support for levels of the building above the foundation. A multistory building has a greater mass, and thus frequently requires multiple load-bearing elements to provide greater surface area to transfer load and provide structural support. One example of a load-bearing element is a wall, which is at least partially embedded into the ground. Another example of a load-bearing element is a column supported by a footing. The footing is embedded in the ground beneath the building and transfers weight from the load-bearing column to the ground beneath the building.

In a building that includes a basement, the foundation is formed below the surface of the surrounding ground. Thus, to form the basement, earth at the site of the building is typically excavated and graded, and the load-bearing elements, such as walls and columns, are inserted into the excavated space. The walls define the shape of the basement, and soil may be backfilled around the walls to return the earth surrounding the basement to grade.

Once the walls and columns of the foundation are in place, a concrete slab is typically poured within the walls and around the columns. The walls of the basement provide the formwork for the poured concrete, which is typically poured onto a base of gravel or crushed stone, to promote drainage, or onto the subsoil. When the poured concrete has solidified, the resulting concrete slab is not part of the foundation, but does provide a solid concrete floor surface to the basement.

As shown in FIG. 1, a typical basement 10, as described above, is shown from a top view. As shown, the walls 14 of the basement 10 may include reentrant corners 18, which accommodate structural features of the building on levels above the basement and provide greater surface area to distribute the load of the building to the ground. Each of the reentrant corners 18 is formed at an intersection between adjacent walls 14, extends inwardly into the basement 10, and subtends an angle of greater than 180°. In other words, each reentrant corner 18 forms the center of a circular arc, which is indicated in FIG. 1 by dashed line 20. Each of the circular arcs 20 extends from one of the adjacent walls 14 of the corner 18 to the other. The circular arc 20 of each of the reentrant corners 18 extends greater than 180°, thus each of the reentrant corners 18 subtends an angle of greater than 180°. In the example shown in FIG. 1, the walls 14 form three reentrant corners 18, each of which subtends an angle of approximately 252°.

The basement 10 also includes columns 22, which can be used to support main floor beams of a post and beam system. The columns 22 are spaced apart from the walls 14 and from one another to further facilitate load distribution by the foundation elements. Wet concrete is poured into the enclosed space formed by the walls 14 and around the columns 22. The poured concrete conforms to the shape between the walls 14 and columns 22, and when the poured concrete solidifies, it forms a concrete slab 26, which provides a solid concrete floor surface to the basement.

One difficulty that is encountered with poured concrete slabs is that the concrete is prone to cracking at the reentrant corners, such as reentrant corners 18 shown in FIG. 1, as well as at support columns, such as columns 22 shown in FIG. 1. As the poured concrete hardens or cures, water evaporates from the concrete, and the concrete shrinks while also adhering to the surrounding walls. As the concrete shrinks and adheres to adjacent walls 14 at a reentrant corner 18 or adjacent sides of a column 22, the concrete is pulled in two orthogonal directions. Thus, reentrant corners 18 and columns 22 concentrate tensile stresses in the concrete. Additionally, the concentration of tensile stresses at reentrant corners 18 and columns 22 reoccurs when the concrete shrinks and expands due to temperature and moisture changes over the lifetime of the concrete slab. In addition to tensile stresses within the concrete as the concrete cures, curling tensile stresses can also occur on the top of the slab during the first few hours after slab placement. These tensile stresses also pull the slab apart at corners.

When the tensile stresses applied to the concrete exceed the tensile strength of the cured concrete, the cured concrete cracks. A crack usually extends diagonally from the apex of each 252° reentrant corner 18 at an angle of about 135°. In other words, the crack usually extends at an angle that is generally equidistant from the adjacent walls 14. As further shrinkage and curling occur, the crack widens and lengthens. Because linear shrinkage and curling continue at a decreasing rate for more than two years, cracks can become quite wide and long. For example, for a concrete slab that is 6 inches thick, the shrinkage that occurs after one year is only 60-80% of the ultimate shrinkage, which means cracks that appear early in the lifetime of a slab can grow significantly over time.

One common strategy to reduce the risk of cracking has been to make small diameter saw cuts in the concrete that are aligned with the structural walls at reentrant corners. For some structures, such as dock pits, doweled construction joints with plate dowels can be used that allow differential movement parallel to the doweled joint. In another approach, diagonal reinforcing bars are embedded at reentrant corners. The reinforcing bars will not prevent the crack from occurring, but will help keep the crack tighter, or narrower, and shorter.

These and other typical strategies to reduce cracking require significant time and/or materials to implement. Some existing strategies may be suitable for industrial applications, such as dock pits for industrial warehouses and loading docks, where cost and construction time limits are not prohibitive. However, in high-volume, low cost scenarios, such as home building, these prior strategies are too expensive and take too much labor and time to implement. Consequently, there is a significant need for a quick, inexpensive, and effective solution to reduce cracking of poured concrete slabs.

SUMMARY

An apparatus for reducing propagation of cracks in concrete has been developed. The apparatus includes a curved panel, and the curved panel includes a convex surface, a concave surface, a top surface, and a bottom surface. The convex surface and the concave surface face away from one another and are separated from one another by a thickness. Each of the convex surface and the concave surface has a top edge, a bottom edge, a first end, and a second end. The top surface of the curved panel extends between the top edge of the convex surface and the top edge of the concave surface. The top surface is substantially planar and is substantially perpendicular to the convex surface and the concave surface.

The bottom surface of the curved panel extends between the bottom edge of the convex surface and the bottom edge of the concave surface. The bottom surface is substantially planar and is substantially parallel to the top surface.

A method for reducing propagation of cracks in concrete has also been developed. The method includes placing at least one curved panel in an area into which concrete is to be poured such that a bottom surface of the curved panel directly contacts a first surface of the area. The method further includes pouring concrete onto the first surface of the area so that the concrete directly contacts a convex surface and a concave surface of the curved panel. The convex surface and the concave surface project in a direction that is substantially perpendicular to the bottom surface of the curved panel. The method further includes ceasing to pour the concrete when substantially an entirety of the convex surface and substantially an entirety of the concave surface are in direct contact with the concrete.

BRIEF DESCRIPTION OF THE DRAWINGS

FIG. 14 A depicts a top plan view of another alternative embodiment of the apparatus of FIG. 2.

FIG. 14B depicts a side perspective view of a first embodiment of the embodiment of FIG. 14A.

FIG. 14C depicts a side perspective view of a second embodiment of the embodiment of FIG. 14A.

FIG. 14D depicts a side perspective view of a third embodiment of the embodiment of FIG. 14A.

DETAILED DESCRIPTION

Figure 1:
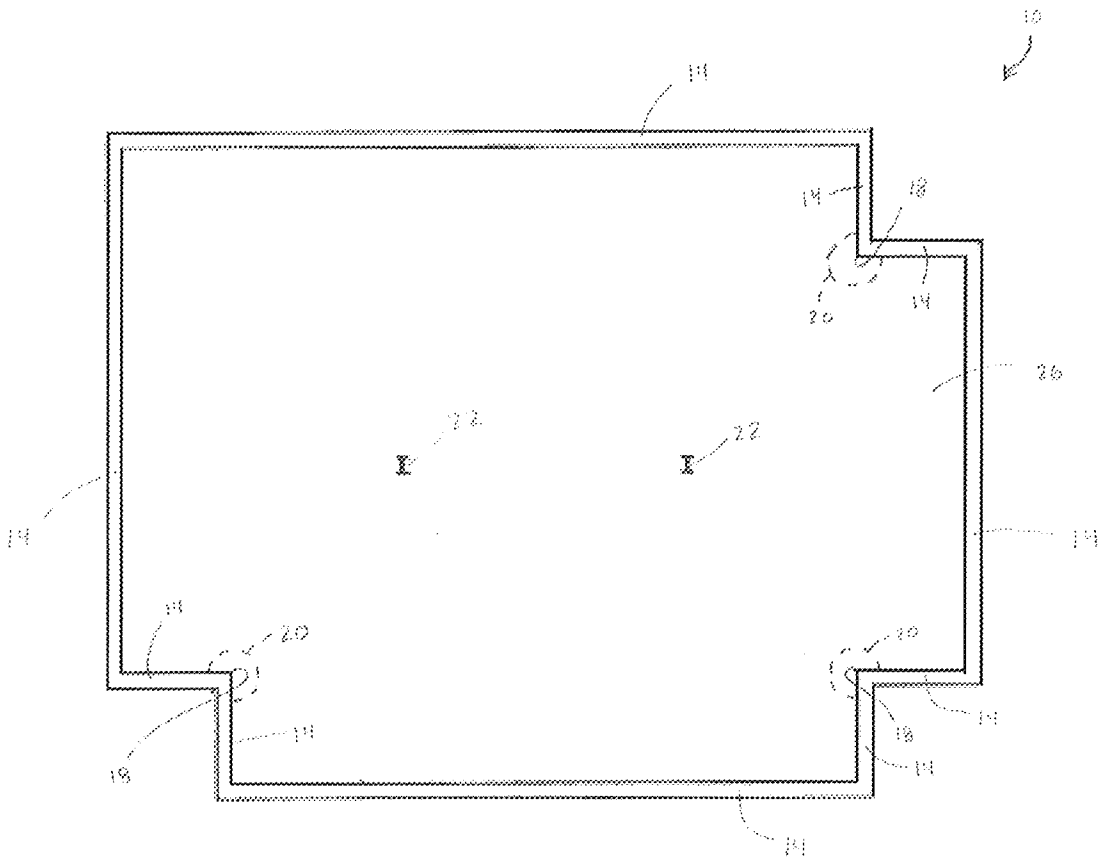
FIG. 1 PRIOR ART
FIG. 1 depicts a top plan view of a prior art basement including a concrete slab.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Figure 2:
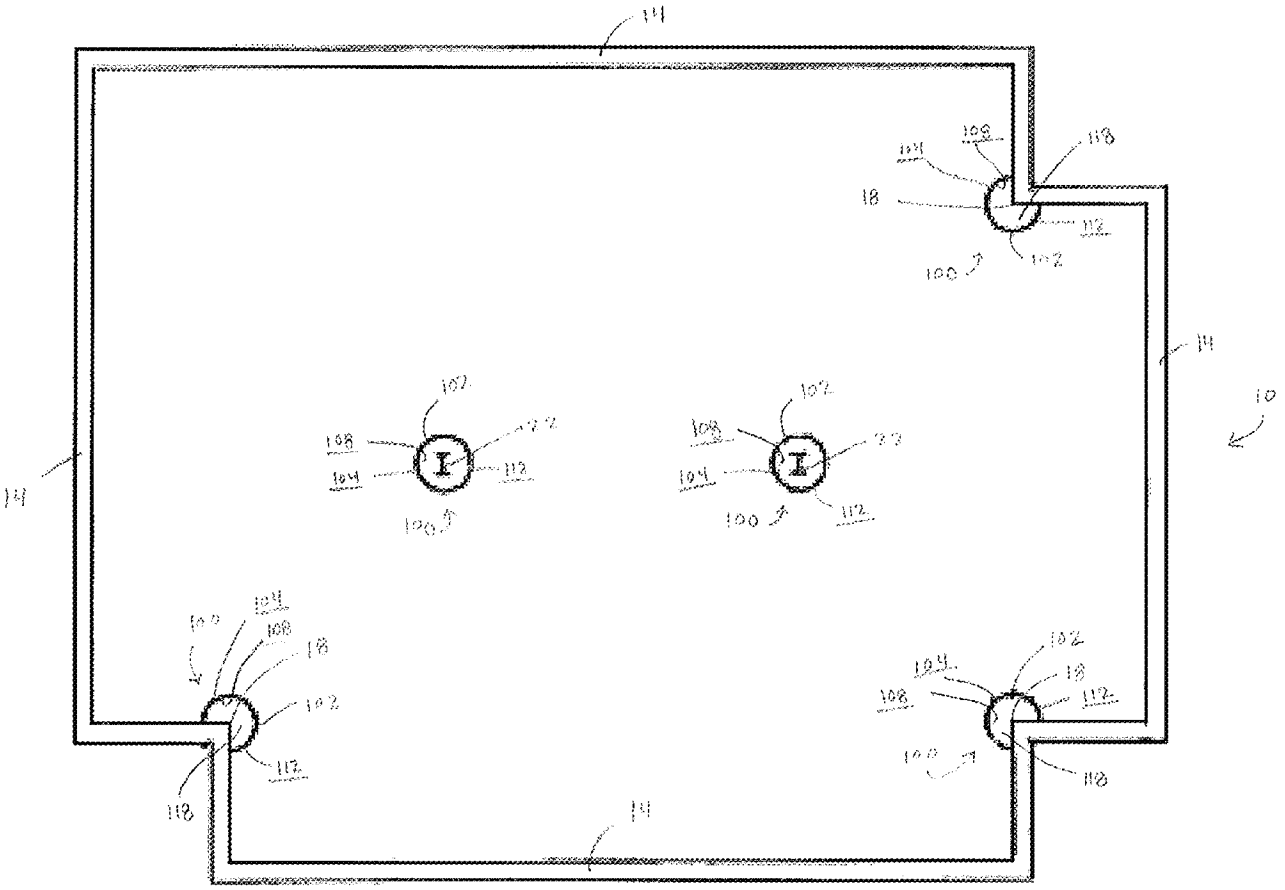
FIG. 2 depicts a top plan view of a basement including an apparatus for reducing crack propagation in the concrete slab of FIG. 1.
Figure 3:
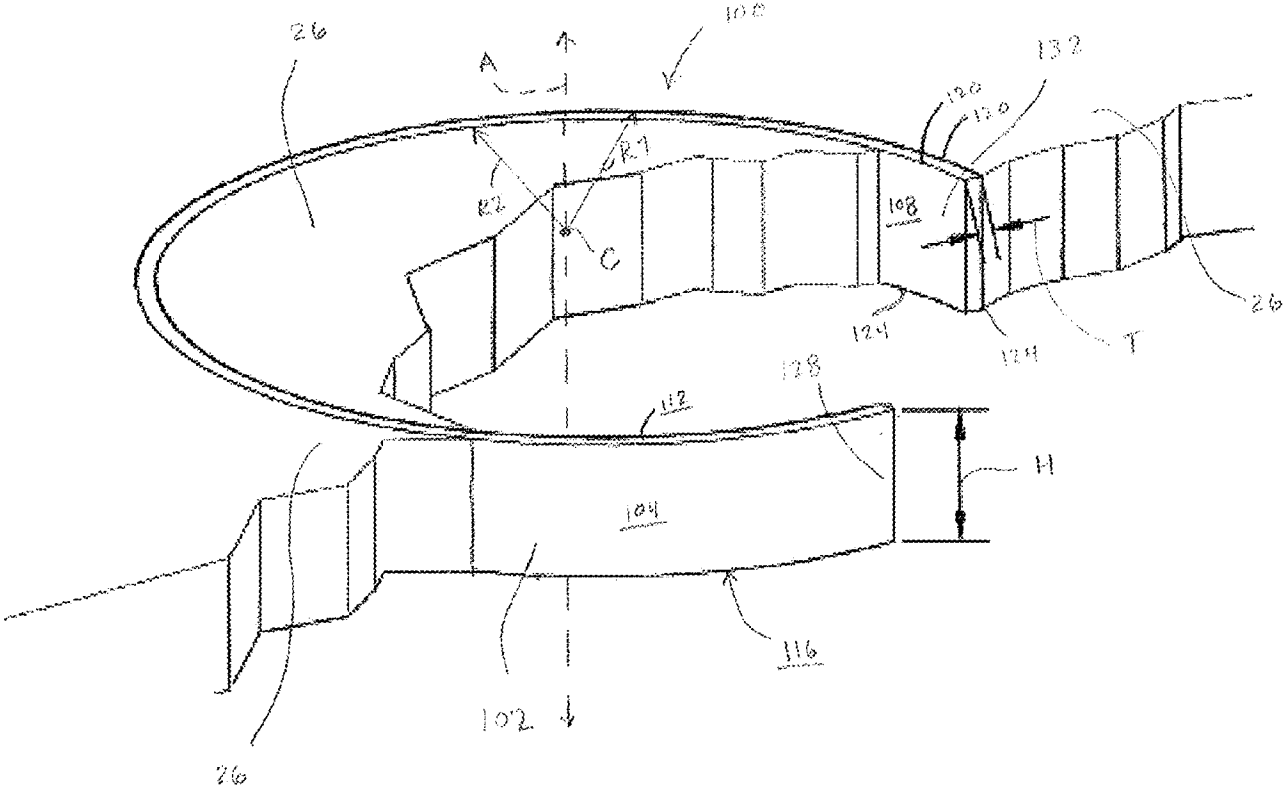
FIG. 3 depicts a partial perspective view of one embodiment of the apparatus of FIG. 2.
Figure 4:
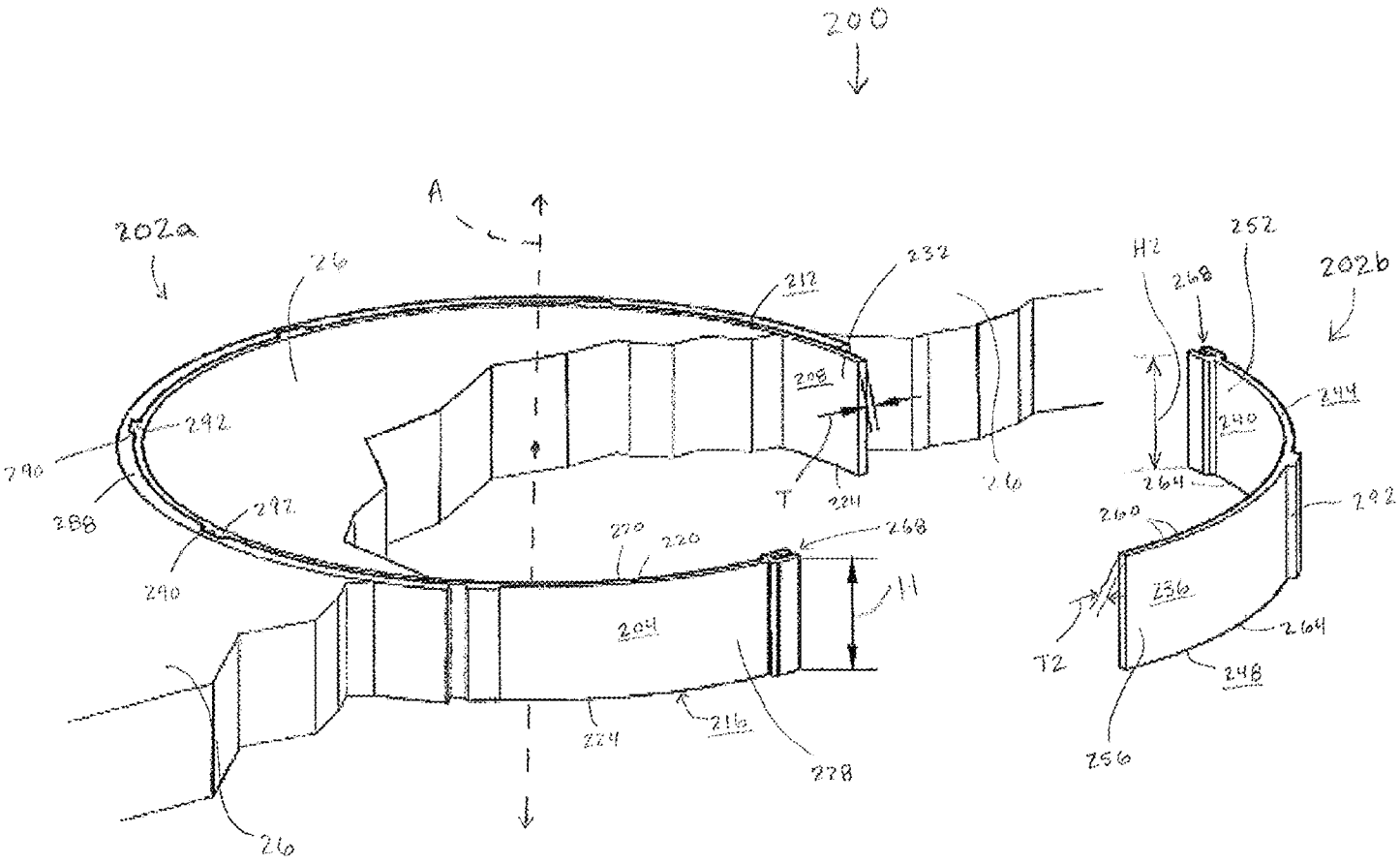
FIG. 4 depicts an exploded partial perspective view of an alternative embodiment of the apparatus of FIG. 2.

The present disclosure provides an apparatus 100 that is arranged at a reentrant corner 18 or around a column 22 to reduce propagation of cracks in concrete. FIG. 2 depicts a top plan view of a plurality of the apparatuses 100 arranged at each reentrant corner 18 and around each column 22 of the basement 10. As described in further detail below, each apparatus 100 includes at least one curved panel 102 having a convex surface 104, a concave surface 108, a top surface 112, and a bottom surface 116 (shown in FIGS. 3 and 4). The bottom surface 116 is arranged opposite the top surface 112. Thus, because FIGS. 2-4 depict a top view and top side perspective views of the apparatus 100, the bottom surface 116 of each of the curved panels 102, is not visible, but is indicated with an arrow in FIGS. 3 and 4. Each apparatus 100 is positioned at a reentrant corner 18 or around a column 22, and wet concrete is poured to cover both the convex and concave surfaces 104, 108 of the at least one curved panel 102 of the apparatus 100. The poured concrete then cures on both the convex and concave surfaces 104, 108 to form the concrete slab 26, and, as described in more detail below, the apparatus 100 reduces propagation of cracks in the concrete slab 26.

FIG. 3 depicts one embodiment of the apparatus 100 including one curved panel 102. As shown, from a top or bottom view, the curved panel 102 is substantially shaped as a circular arc about a center C. As described in further detail below, the curved panel 102 has a height H extending from the top surface 112 to the bottom surface 116. Thus, from a perspective view, the curved panel 102 is substantially shaped as a sector of a hollow circular cylinder having an axis A that includes the center C. In other words, the axis A of the is coincident with the center C. In alternative embodiments, the curved panel 102 need not be substantially shaped as a circular arc or sector of a hollow circular cylinder. Instead, the curved panel 102 can be shaped as a portion of an oval or another smooth curved shape that does not form corners on the convex or concave surfaces 104, 108. By having a curved panel 102 with a smooth curved shape, the apparatus 100 does not generate its own tensile stress concentrations in the concrete.

In the embodiment of the apparatus 100 shown in FIG. 3, the curved panel 102 extends approximately 252° circumferentially about the axis A and the center C. Thus, each of the convex surface 104, the concave surface 108, the top surface 112, and the bottom surface 116 also extends approximately 252° circumferentially about the axis A and the center C. In other words, the circular arc of the curved panel 102 subtends an angle of approximately 252°.

The apparatus 100 of this embodiment is best suited for use at reentrant corners 18. As shown in FIG. 2, because the curved panel 102 extends approximately 252° about the axis A, when the apparatus 100 is placed at a reentrant corner 18 such that the corner 18 is nearly or approximately coincident with the axis A, the curved panel 102 abuts both walls 14 adjacent to the reentrant corner 18. Abutting the walls 14 enables the curved panel 102 to isolate the reentrant corner 18 and form an enclosed area 118 between the reentrant corner 18 and the concave surface 108 of the curved panel 102. By isolating the reentrant corner 18 and forming the enclosed area 118, the curved panel 102 can reduce propagation of cracks outwardly from the reentrant corner 18.

Returning to FIG. 3, the convex surface 104 and the concave surface 108 of the curved panel 102 are arranged concentrically about the axis A and are spaced apart from one another by a thickness T of the curved panel 102. The convex surface 104 is arranged opposite the concave surface 108 such that the convex surface 104 and the concave surface 108 face away from one another. More specifically, the concave surface 108 faces toward the axis A, and the convex surface 104 faces away from the axis A. Additionally, the convex surface 104 is defined at a first radius R1 from the center C, and the concave surface 108 is defined at a second radius R2, which is smaller than the first radius R1, from the center C, such that the convex surface 104 is arranged substantially concentrically outside the concave surface 108. Thus, the thickness T of the curved panel 102 is equal to the difference between the first radius R1 and the second radius R2.

The lengths of the first and second radii R1, R2 and the thickness T are sized based on the particular application of the apparatus 100. The first and second radii R1, R2 are long enough to encompass the typical region of tensile stress concentrations surrounding the reentrant corner 18. The thickness T is large enough to provide structural stability to the apparatus 100 and withstand the pressure applied to the convex and concave surfaces 104, 108 by the poured concrete. The first radius R1 of the convex surface 104 can be, for example, between approximately 6.25 inches and approximately 12.25 inches long. The second radius R2 of the concave surface 108 can be, for example, between approximately 6 inches and approximately 12 inches long. The thickness T of the curved panel 102 can be, for example, between approximately 0.125 and approximately 0.25 inches.

The thickness T of the curved panel 102 is also sized based on the material used to form the curved panel 102. For example, a curved panel 102 formed from a material having a higher compressive strength can have a smaller thickness T than a curved panel 102 formed from a material having a lower compressive strength. The curved panel 102 can be composed of a natural or a synthetic material, a new or a recycled material, or a derivative or combination of natural, synthetic, new, and recycled materials. In one embodiment, the curved panel 102 can be composed of a rigid plastic, such as PVC.

In the embodiment shown in FIG. 3, the convex and concave surfaces 104, 108 are substantially smooth. In alternative embodiments, however, either or both of the convex and concave surfaces 104, 108 can include a surface finish, texture, or one or more raised or recessed element to facilitate integration of the curved panel 102 with the poured concrete and the cured concrete slab 26. For example, either or both of the convex and concave surfaces 104, 108 can be smooth, corrugated, ribbed, textured, fluted, splined, toothed, threaded, ratcheted, dimpled, grooved, striated, embossed, or patterned. Alternatively, the convex and concave surfaces 104, 108 can include any combination of these surface features on any axis and oriented in any direction. Furthermore, the convex and concave surfaces 104, 108 can have different surface features, different combinations of surface features, and/or different arrangements of surface features.

Each of the convex and concave surfaces 104, 108 also has a top edge 120 and a bottom edge 124. The bottom edge 124 of the convex surface 104 is opposite the top edge 120 of the convex surface 104. Likewise, the bottom edge 124 of the concave surface 108 is opposite the top edge 120 of the concave surface 108. The top edges 120 of each of the convex and concave surfaces 104, 108 are spaced apart from the respective bottom edges 124 by the height H of the curved panel 102. The height H of the curved panel 102 is sized based on a height of the concrete slab 26.

More specifically, the height H of the curved panel 102 is approximately equal to the height of the concrete slab 26. The height H of the curved panel 102 is large enough so that, when the bottom edges 124 of the convex and concave surfaces 104, 108 are substantially coplanar with the bottom of the concrete slab 26, the top edges 120 of the convex and concave surfaces 104, 108 are substantially coplanar with the top of the concrete slab 26. Typical thicknesses of concrete slabs 26 include approximately 3.5 inches, approximately 5.5 inches, and approximately 7.5 inches. Accordingly, the height H of the curved panel 102 can be, for example, approximately 3.5 inches, approximately 5.5 inches, or approximately 7.5 inches to correspond to the height of the concrete slab 26.

The top edges 120 of each of the convex and concave surfaces 104, 108 are substantially coplanar with one another, and the bottom edges 124 of each of the convex and concave surfaces 104, 108 are substantially coplanar with one another. In other words, the top edges 120 of the convex and concave surfaces 104, 108 lie in a common plane and the bottom edges 124 of the convex and concave surfaces 104, 108 lie in a common plane. Additionally, the common plane in which the top edges 120 are coplanar is substantially parallel to the common plane in which the bottom edges 124 are coplanar.

The top surface 112 and the bottom surface 116 of the curved panel 102 are formed between the convex and concave surfaces 104, 108 of the curved panel 102. More specifically, the top surface 112 extends between the top edges 120 of the convex and concave surfaces 104, 108 and spans the thickness T of the curved panel 102. Similarly, the bottom surface 116 extends between the bottom edges 124 of the convex and concave surfaces 104, 108 and spans the thickness T of the curved panel 102. Accordingly, the top surface 112 is spaced apart from the bottom surface 116 by the height H of the curved panel 102.

Each of the top and bottom surfaces 112, 116 of the curved panel 102 is substantially planar and smooth. The top surface 112 is substantially planar and smooth such that it forms a substantially smooth, continuous surface with the top of the concrete slab 26. The bottom surface 116 is substantially planar and smooth to enable the bottom surface 116 to rest stably and securely on the base of gravel or crushed stone or on the subsoil onto which the wet concrete is to be poured. Thus, the bottom surface 116 forms a substantially continuous surface with the bottom of the concrete slab 26. The top and bottom surfaces 112, 116 are also substantially parallel to one another. Additionally, the top and bottom surfaces 112, 116 of the curved panel 102 are substantially perpendicular to the axis A. Thus, the top and bottom surfaces 112, 116 are also substantially perpendicular to the convex and concave surfaces 104, 108, which extend the height H along the axis A.

Each of the convex and concave surfaces 104, 108 extends from a first end 128 of the curved panel 102 to a second end 132 of the curved panel 102. Thus, the top edges 120 and the bottom edges 124 of the convex and concave surfaces 104, 108 extend from the first end 128 to the second end 132, and the top surface 112 and the bottom surface 116 of the curved panel 102 extend from the first end 128 to the second end 132. The first end 128 and the second end 132 of the curved panel 102 are arranged opposite one another. In other words, the first and second ends 128, 132 are arranged at opposite ends of the arc of the curved panel 102.

In use, the apparatus 100 is arranged in the basement 10 (shown in FIG. 2) at a reentrant corner 18. More specifically, the apparatus 100 is positioned such that the bottom surface 116 of the curved panel 102 rests on the base of gravel or crushed stone or on the subsoil onto which the wet concrete is to be poured. Furthermore, the apparatus 100 is positioned such that the first end 128 abuts one wall 14 of the reentrant corner 18 and the second end 132 abuts the other wall 14 of the reentrant corner 18, and the enclosed area 118 is formed between the walls 14 and the concave surface 108. In at least one embodiment, the bottom surface 116 and/or the first and second ends 128, 132 can be affixed to the base and walls 14, respectively, at least temporarily, to retain the apparatus 100 in this position when the wet concrete is poured. For example, the bottom surface 116 and/or first and second ends 128, 132 can be affixed to the base and walls 14, respectively, by a quick-setting epoxy suitable for adhering the material of the curved panel 102 to the base and walls 14.

Once the apparatus 100 is positioned as described above, wet concrete is poured in a typical manner within the enclosed area 118 and around the apparatus 100. Thus, wet concrete is poured such that it is in contact with both the convex surface 104 and the concave surface 108 of the curved panel 102. Wet concrete is poured until the concrete is flush with the top edges 120 of both the convex surface 104 and the concave surface 108. Accordingly, wet concrete is poured until the concrete is flush with the top surface 112 of the curved panel 102 within the enclosed area 118 as well as outside of the enclosed area 118. The poured concrete then cures in direct contact with an entirety of the convex surface 104 and an entirety of the concave surface 108 to form the concrete slab 26. As depicted in FIG. 3, a portion of the concrete slab 26 has been removed from inside the enclosed area 118 and a portion has been removed from outside of the enclosed area 118 to facilitate visual interpretation of the drawing.

As the poured concrete cures to form the concrete slab 26, the apparatus 100 will contain any cracks originating at the reentrant corner 18 and prevent the cracks from propagating outside of the enclosed area 118. Cracks are unlikely to originate at the convex surface 104 of the curved panel 102, because the curvature reduces the concentration of tensile stresses on the concrete as the concrete cures. Accordingly, the apparatus 100 reduces the propagation of cracks in the concrete slab 26.

FIG. 4 depicts an alternative embodiment of the apparatus 200. The apparatus 200 includes a first curved panel 202*a* and a second curved panel 202*b*, which are configured to fit together to form a closed hollow circular cylinder. Thus, the apparatus 200 of this embodiment is suitable for use around a column 22 by fitting the first and second curved panels 202*a*, 202*b* together. Alternatively, the apparatus 200 is also suitable for use at a reentrant corner 18 by using the first curved panel 202*a* alone in a manner similar to the curved panel 102 shown in FIG. 3 and described in detail above.

The first curved panel 202*a* is substantially similar in structure and function to the curved panel 102 of the apparatus 100. In particular, the first curved panel 202*a* extends approximately 252° about the axis A. In other words, the first curved panel 202*a* subtends an angle of approximately 252°. When the first curved panel 202*a* and the second curved panel 202*b* are fitted together, the second curved panel 202*b* extends approximately 90° about the axis A. In other words, the second curved panel 202*b* subtends an angle of approximately 90°. Accordingly, when the first curved panel 202*a* and the second curved panel 202*b* are fitted together, they form a closed hollow circular cylinder.

Like the curved panel 102, the first curved panel 202*a* includes a convex surface 204, a concave surface 208, a top surface 212, a bottom surface 216, a first end 228, and a second end 232. Furthermore, the convex and concave surfaces 204, 208 include top edges 220 and bottom edges 224. Like the first curved panel 202*a*, the second curved panel 202*b* includes a convex surface 236, a concave surface 240, a top surface 244, a bottom surface 248, a first end 252, and a second end 256. Furthermore, the convex and concave surfaces 236, 240 include top edges 260, bottom edges 264. When the first and second curved panels 202*a*, 202*b* are fitted together, the convex surfaces 204, 236 are aligned with one another and the concave surfaces 208, 240 are aligned with one another to form substantially smooth, continuous surface convex and concave surfaces. Similarly, the top surfaces 212, 244 are aligned with one another and the bottom surfaces 216, 248 are aligned with one another to form substantially smooth, continuous surfaces. Additionally, a height H2 and thickness T2 of the second curved panel 202*b* are substantially equal to the height H and thickness T, respectively, of the first curved panel 202*a*, so that when the first and second curved panels 202*a*, 202*b* are fitted together, they form a substantially smooth, continuous unit.

When the first and second curved panels 202*a*, 202*b* are fitted together, they form the enclosed area 118. In particular, the first end 228 of the first curved panel 202*a* is fitted together with the second end 256 of the second curved panel 202*b* and the second end 232 of the first curved panel 202*a* is fitted together with the first end 252 of the second curved panel 202*b* to form a continuous curve encircling the enclosed area 118.

In at least one embodiment, the first and second curved panels 202*a*, 202*b* can be fitted and retained together via one or more engagement features. For example, as shown in FIG. 4, each of the first end 228 of the first curved panel 202*a* and the first end 252 of the second curved panel 202*b* includes an engagement feature 268. The engagement feature 268 on the first end 228 on the first curved panel 202*a* is configured to matingly engage with the second end 256 of the second curved panel 202*b*, and the engagement feature 268 on the first end 252 of the second curved panel 202*b* is configured to matingly engage with the second end 232 of the first curved panel 202*a*.

Figure 5:
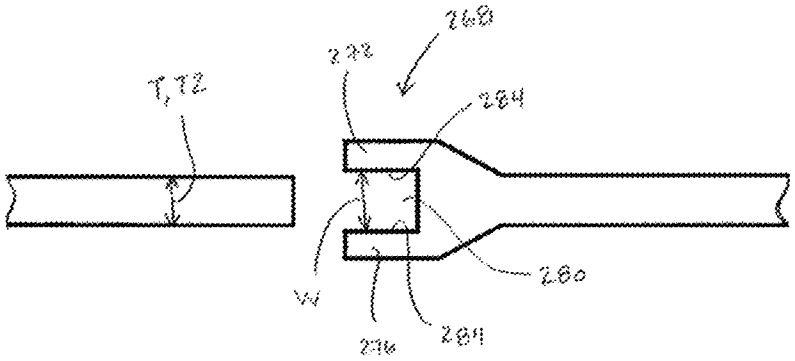
FIG. 5 depicts a top plan view of a portion of the alternative embodiment of the apparatus of FIG. 4.

FIG. 5 depicts a top plan view of one of the engagement features 268 in more detail. Because the engagement features 268 on the first and second curved panels 202*a*, 202*b* are the same, the description of one of the engagement features 268 applies to both. The engagement feature 268 includes a first prong 272 and a second prong 276, each of which extends vertically along the entire height H, H2 of the respective curved panel, as shown in FIG. 4. The first and second prongs 272, 276 are arranged substantially parallel to one another and spaced apart from one another by a slot 280. In particular, inwardly facing, parallel surfaces 284 of the first and second prongs 272, 276, which face toward one another, delimit the slot 280. The first and second prongs 272, 276 are arranged such that the surfaces 284 are substantially concentric with the convex and concave surfaces of the curved panels. The distance between the surfaces 284 of the first and second prongs 272, 276 forms a width W of the slot 280, and the width W of the slot 280 is larger than the thicknesses T, T2 of the curved panels 202*a*, 202*b*.

When the first and second curved panels 202*a*, 202*b* are fitted together via the engagement features 268, the second end 256 of the second curved panel 202*b* is slidingly received in the slot 280 between the first and second prongs 272, 276 of the engagement feature 268 on the first end 228 of the first curved panel 202*a*. Likewise, the second end 232 of the first curved panel 202*a* is slidingly received in the slot 280 between the first and second prongs 272, 276 of the engagement feature 268 on the first end 252 of the second curved panel 202*b*.

In at least one embodiment, the apparatus 200 can further include an expansion collar or material configured to further accommodate shrinkage of poured concrete within the apparatus 200 and outside of the apparatus 200. For example, as shown in FIG. 4, the expansion collar 288 includes a plurality of vertical notches 290 configured to receive corresponding ribs 292, which project outwardly from the convex surfaces 204, 236 of the first and second curved panels 202*a*, 202*b*. The ribs 292 extend vertically along the entire height H, H2 of the first and second curved panels 202*a*, 202*b*. The expansion collar 288 is sized and configured to fit substantially concentrically around the first and second curved panels 202*a*, 202*b* such that the ribs 292 are slidingly received in the notches 290. If the expansion collar 288 is used with only one of the first and second curved panels 202*a*, 202*b*, the expansion collar 288 is sized and configured to fit substantially concentrically around only that one of the first and second curved panels 202*a*, 202*b*.

When an expansion collar 288 is used with the apparatus 200, the concave surfaces 208, 240 of the first and second curved panels 202*a*, 202*b* are contacted by concrete poured inside the apparatus 200, but the convex surfaces 204, 236 are not contacted by the concrete poured outside the apparatus 200 because the convex surfaces 204, 236 are covered by the expansion collar 288. Thus, conversely, a concave side (not visible in the drawings) of the expansion collar 288 is not contacted by the concrete poured inside the apparatus 200, because it is covered by the first and second curved panels 202*a*, 202*b*, and a convex side (not visible in the drawings) of the expansion collar 288 is contacted by concrete poured outside the apparatus 200.

Accordingly, as the poured concrete cures, the concrete poured inside the apparatus 200 shrinks and adheres to the concave surfaces 208, 240, pulling the first and second curved panels 202*a*, 202*b* more tightly together. The concrete poured outside the apparatus 200, however, shrinks and adheres to the convex surface (not shown) of the expansion collar 288, applying tension to the expansion collar 288. The first and second curved panels 202*a*, 202*b* are concentrically received within the expansion collar 288 such that, as the first and second curved panels 202*a*, 202*b* are contracted and the expansion collar 288 is expanded, the first and second curved panels 202*a*, 202*b* and the expansion collar 288 can move relative to one another, further preventing the formation of cracks.

Figure 6:
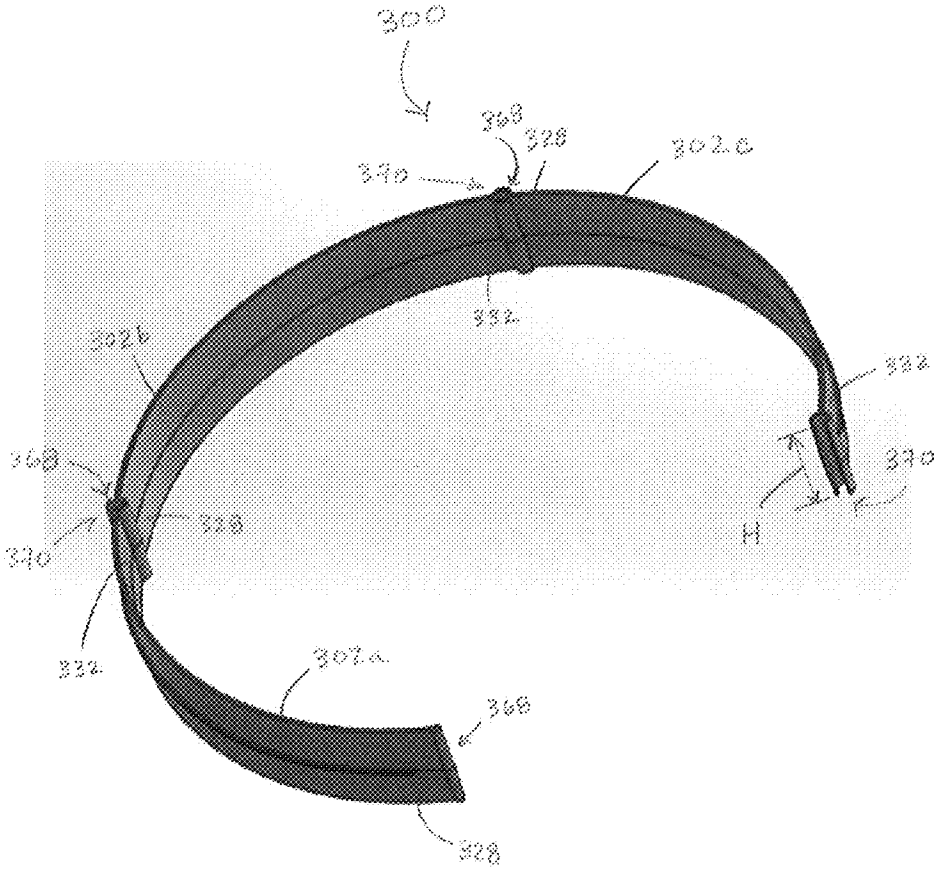
FIG. 6 depicts a top, side perspective view of another alternative embodiment of the apparatus of FIG. 2.

FIG. 6 depicts another alternative embodiment of the apparatus 300. The apparatus 300 is similar to the apparatus 200. However, as shown in FIG. 6, the apparatus 300 includes curved panels 302*a*, 302*b*, 302*c* that each subtend an angle of approximately 90°. In other words, each of the curved panels 302*a*, 302*b*, 302*c* is similar to the second curved panel 202*b* of the apparatus 200, shown in FIG. 4 and described in detail above. Accordingly, two of the curved panels 302 can be used to form an apparatus 300 that is a semi-circle, subtending an angle of approximately 180°, and four of the curved panels 302 can be used to form an apparatus 300 that is a complete, continuous 360° circle.

Like the first and second curved panels 202*a*, 202*b* of apparatus 200, each of the curved panels 302*a*, 302*b*, 302*c* has a first end 328 and a second end 332. The first end 328 of each of the curved panels 302 includes a first engagement feature 368, and the second end 332 of each of the curved panels 302 includes a second engagement feature 370. In the embodiment shown in FIG. 6, each of the first engagement features 368 is an elongated protuberance extending vertically along the entire height H of the curved panel 302, and each of the second engagement features 370 is a c-shaped sleeve extending vertically along the entire height H of the curved panel 302 and configured to slidingly receive the elongated protuberance of a first engagement feature 368 therein.

Figure 7:
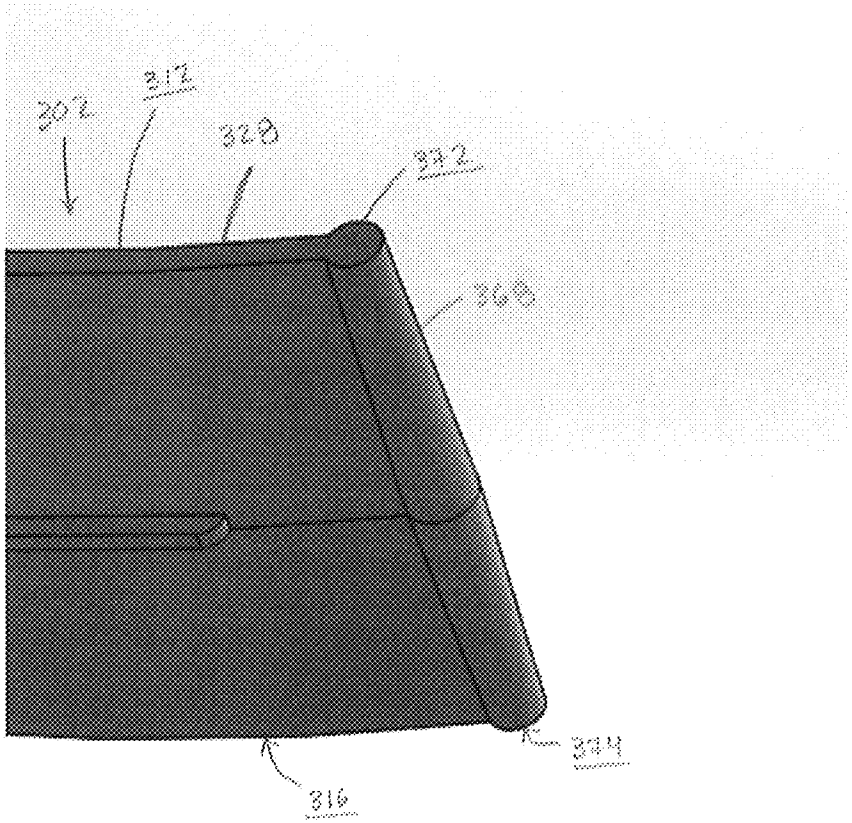
FIG. 7 depicts a top, side perspective view of a portion of the alternative embodiment of the apparatus of FIG. 6.

FIG. 7 depicts a top, side perspective view of one of the first engagement features 368 in more detail. Because the first engagement feature 368 on each of the curved panels 302 is the same, the description of one of the engagement features 368 applies to all. The first engagement feature 368, which is an elongated protuberance, is generally cylindrically shaped, and is arranged such that a generally circular top end surface 372 of the cylinder is flush and coplanar with a top surface 312 of the curved panel 302. Similarly, a generally circular bottom end surface 374 of the cylinder is flush and coplanar with a bottom surface 316 of the curved panel 302. Neither of the bottom end surface 374 and the bottom surface 316 is visible in FIG. 7, but their locations are indicated with arrows.

Figure 8:
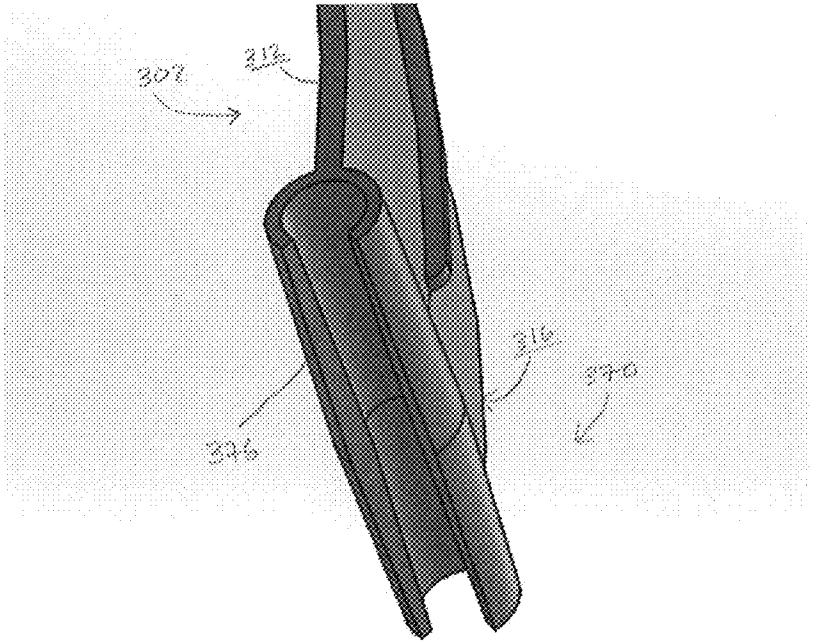
FIG. 8 depicts a top, side perspective view of another portion of the alternative embodiment of the apparatus of FIG. 6.

FIG. 8 depicts a top, side perspective view of one of the second engagement features 370 in more detail. Because the second engagement feature 370 on each of the curved panels 302 is the same, the description of one of the second engagement features 370 applies to all. The second engagement feature 370, which is a c-shaped sleeve, is generally cylindrical and hollow, and has an opening 376 leading into the hollow cylinder. The c-shaped sleeve 372 is flush and coplanar with the top surface 312 and the bottom surface 316 of the curved panel 203, and the opening 376 is arranged to extend vertically from the top surface 312 to the bottom surface 316.

Figure 9:
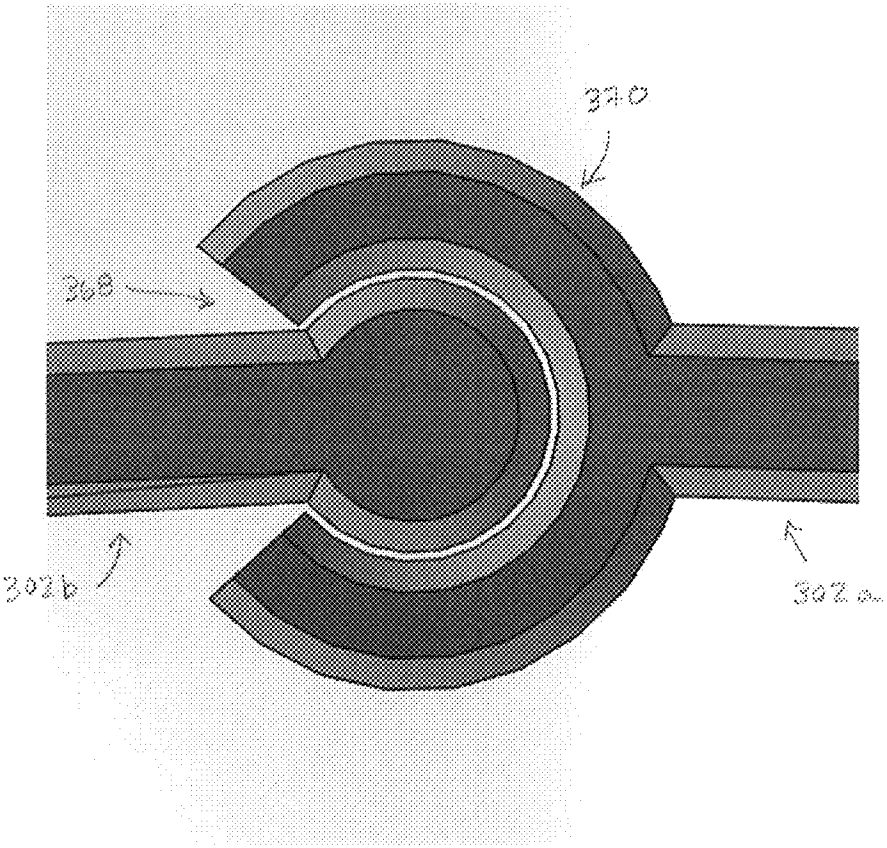
FIG. 9 depicts a top plan view of the portion of FIG. 7 engaged with the portion of FIG. 8.

Accordingly, as shown in FIG. 9, the c-shaped sleeve of the second engagement feature 370 of a first of the curved panels 302 is configured to slidingly receive the elongated protuberance of the first engagement feature 368 of a second of the curved panels 302 therein. When the first engagement feature 368 of a first curved panel 302 is slidingly received in the second engagement feature 370 of an adjacent curved panel 302, the first end 328 of the first curved panel 302 extends through the opening 376 of the second engagement feature 370 of the adjacent curved panel 302.

Figure 10B:
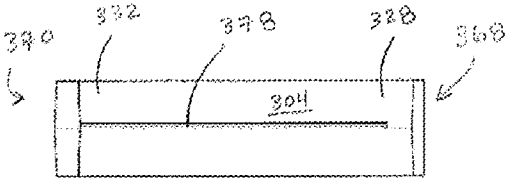
FIG. 10B depicts a side elevational view of the embodiment of FIG. 10A.
Figure 10C:
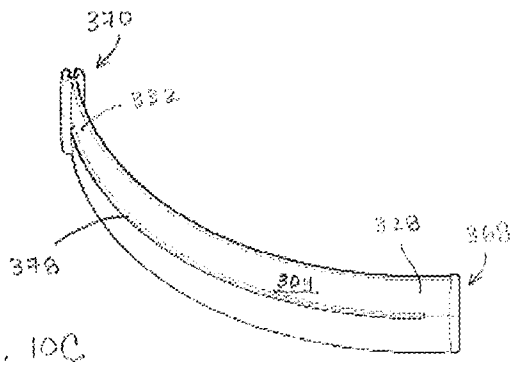
FIG. 10C depicts a top, side perspective view of the embodiment of FIG. 10A.
Figure 10A:
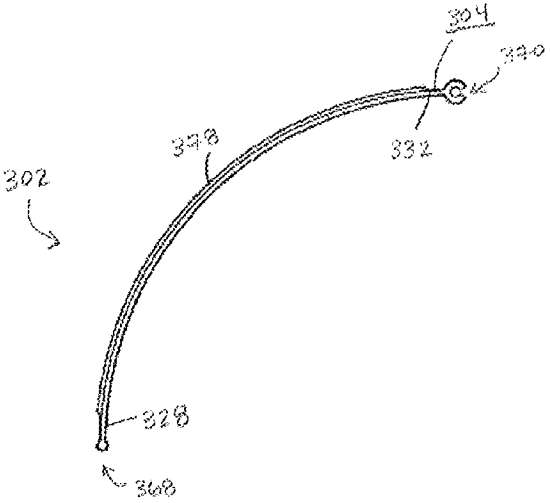
FIG. 10A depicts a top plan view of an embodiment of the apparatus of FIG. 6.

FIG. 10A depicts a top plan view of one of the curved panels 302, FIG. 10B depicts a side elevational view of the curved panel 302, and FIG. 10C depicts a top, front perspective view of the curved panel 302. As shown in FIGS. 10A-10C, the curved panel 302 includes a rib 378 extending outwardly from the convex surface 304 of the curved panel 302. The rib 378 extends horizontally along the curved panel 302 from a location at or near the first end 328 to a location at or near the second end 332. The rib 378 is sized and configured to provide additional surface area and thus further facilitate integration of the curved panel 302 into concrete poured on the convex surface 304. In alternative embodiments, the rib 378 can be made up of a plurality of ribs and can have different shapes or sizes as appropriate to provide additional surface area and facilitate integration of the curved panel 302 into poured concrete.

Figure 11A:
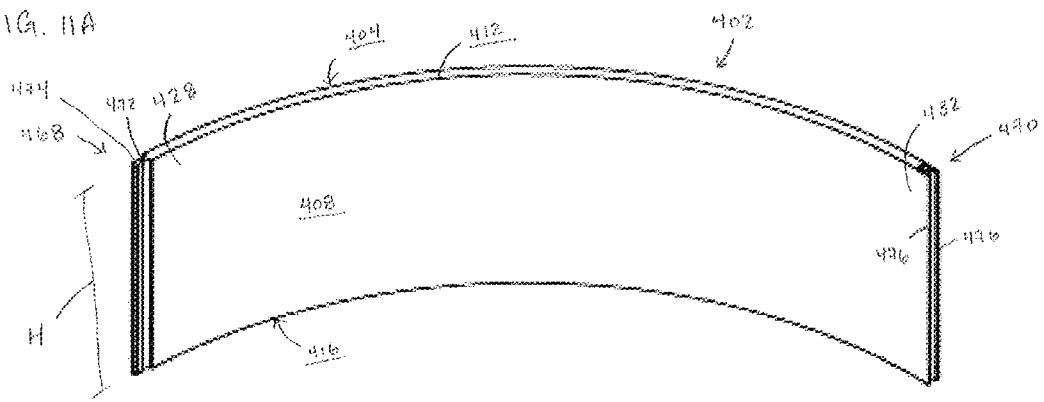
FIG. 11A depicts a top, side perspective view of another alternative embodiment of the apparatus of FIG. 2.
Figure 11B:
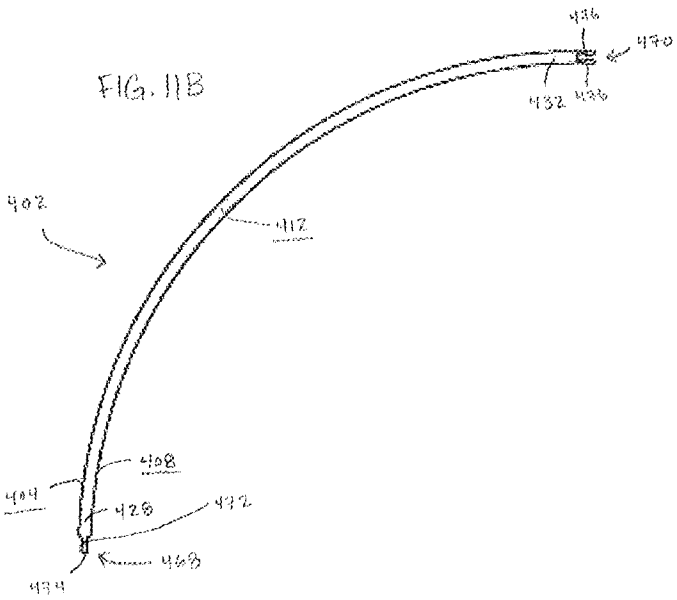
FIG. 11B depicts a top plan view of the embodiment of FIG. 11A.

FIGS. 11A and 11B depict a curved panel 402 of another alternative embodiment of the apparatus 400. The apparatus 400 is similar to the apparatus 300 and, as shown in FIG. 11B, each curved panel 402 subtends an angle of approximately 90°. Like the curved panels 302, the curved panel 402 has a convex surface 404, a concave surface 408, a top surface 412, a bottom surface 416, a first end 428, which includes a first engagement feature 468, and a second end 432, which includes a second engagement feature 470.

In the embodiment shown in FIGS. 11A and 11B, the first engagement feature 468 includes an elongated rib 472 arranged so as to extend from a position between the convex surface 404 and the concave surface 408. The first engagement feature 468 further includes a head 474 extending from the elongated rib 472 in a direction away from the remainder of the curved panel 402. In other words, the head 474 is spaced as far away as possible on the curved panel 402 from the second end 432 of the same curved panel 402. Both the elongated rib 472 and the head 474 extend from the top surface 412 to the bottom surface 416 of the curved panel 402, such that the first engagement feature 468 extends along the entire height H of the curved panel 402.

Figure 11C:
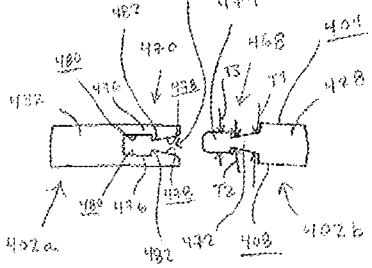
FIG. 11C depicts a top plan view of a first portion and a second portion of the embodiment of FIG. 11A.

As shown in more detail in FIG. 11C, the elongated rib 472 has a tapered shape that has a largest thickness T1 nearest to the convex surface 404 and the concave surface 408 and a smallest thickness T2 nearest to the head 474. The head 474 has a thickness T3 that is larger than the smallest thickness T2 of the elongated rib 472. For example, the thickness T3 of the head 474 can be approximately equal to the largest thickness T1 of the elongated rib 472. Each of the largest thickness T1 and the smallest thickness T2 of the elongated rib 472 and the thickness T3 of the head 474 is measured in a direction parallel to the top surface 412 of the curved panel 402.

Returning to FIGS. 11A and 11B, the second engagement feature 470 on the second end 432 of the curved panel 402 is configured to matingly fit with the first engagement feature 468 on the first end 428 of the curved panel 402. In particular, the second engagement feature 470 includes two latching walls 476 separated from one another by a gap 477 and configured to fit around and retain the head 474 of a first engagement feature 468 of an adjacent curved panel 402. Thus, the gap 477 is sized and configured to receive and retain the first engagement feature 468 of the adjacent curved panel 402. One of the latching walls 476 extends from the convex surface 404 and the other of the latching walls 476 extends from the concave surface 408.

More specifically, as shown in FIG. 11C, each of the latching walls 476 includes an inwardly facing tapered surface 478 and an inwardly facing flat surface 480 separated from one another by a latching ledge 482. Thus, the inwardly facing tapered surfaces 478 face toward one another and the inwardly facing flat surfaces 480 face toward one another. The inwardly facing flat surfaces 480 are arranged nearer to the remainder of the curved panel 402. In other words, the inwardly facing tapered surface 478 are spaced as far away as possible on the curved panel 402 from the first end 428 of the same curved panel 402.

FIG. 11C shows the second end 432 of a first curved panel 402*a* and the first end 428 of a second curved panel 402*b* to illustrate how the first engagement feature 468 is configured to matingly fit with the second engagement feature 470. To matingly fit the first engagement feature 468 of the second curved panel 402*b* with the second engagement feature 470 of the first curved panel 402*a*, the head 474 is inserted into the gap 477 between the inwardly facing tapered surfaces 478. As the head 474 is inserted further into the gap 477, the head 474 contacts the inwardly facing tapered surfaces 478 to drive the latching walls 476 away from one another. The latching walls 476 are made of an elastic, semi-flexible material, such that they are able to flex as the head 474 drives them apart from one another.

Once the head 474 has been inserted past the latching ledges 482, the latching walls 476 are free to move back to their original positions, nearer to one another, around the smaller thickness T2 of the elongated rib 472. Thus, once the head 474 has been inserted between the inwardly facing flat surfaces 480, the elongated rib 472 is positioned between the inwardly facing tapered surfaces 478, and the first engagement feature 468 is matingly fitted with the second engagement feature 470 to retain the first and second curved panels 402*a*, 402*b* interlocked together.

Figures 12A, 12B, 12C, 12D:
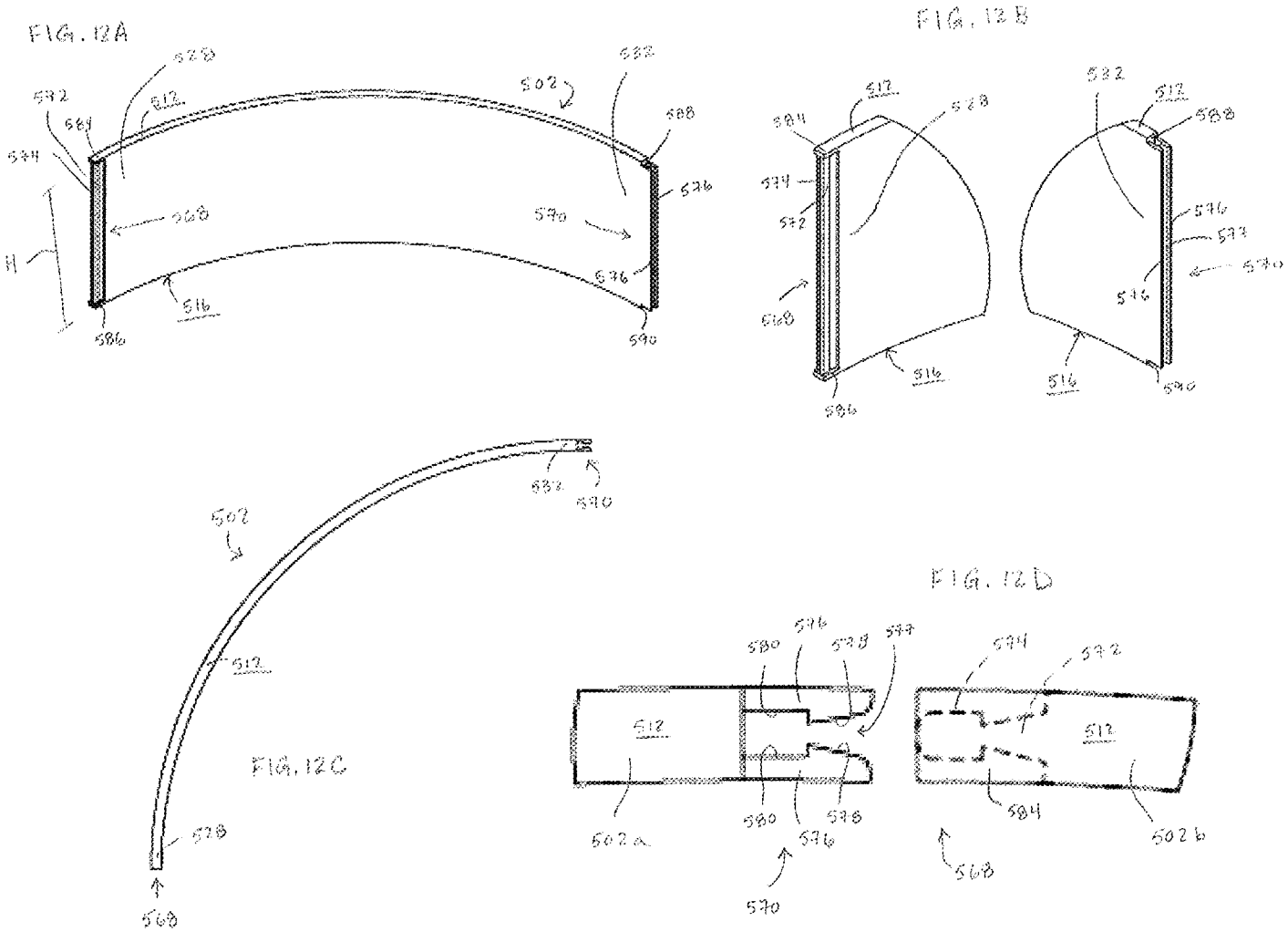
FIG. 12A depicts a top, side perspective view of another alternative embodiment of the apparatus of FIG. 2.
FIG. 12B depicts a top, side perspective view of a first portion and a second portion of the embodiment of FIG. 12A.
FIG. 12C depicts a top plan view of the embodiment of FIG. 12A.
FIG. 12D depicts a top plan view of a first portion and a second portion of the embodiment of FIG. 12A.

FIG. 12A-12D depict a curved panel 502 of another alternative embodiment of the apparatus 500. The apparatus 500 is similar to the apparatus 400 and, as shown in FIG. 12C, each curved panel 502 subtends an able of approximately 90°. Like the curved panels 402, the curved panel 502 has a first engagement feature 568, which includes an elongated rib 572 and a head 574, on a first end 528 of the curved panel 502, and a second engagement feature 570, which includes two latching walls 576 separated by a gap 577, on a second end 532 of the curved panel 502. The first and second engagement features 568, 570 are configured and function in a manner substantially similar to that described above with respect to the first and second engagement features 468, 470 of the curved panel 402. However, the first engagement feature 568 of the curved panel 502 further includes a top wall 584 and a bottom wall 586, and the second engagement feature 570 of the curved panel 502 further includes a top gap 588 and a bottom gap 590.

As shown in FIG. 12B, the top wall 584 is an extension of the top surface 512 of the curved panel 502 that extends over the elongated rib 572 and the head 574 of the first engagement feature 568. Similarly, the bottom wall 586 is an extension of the bottom surface 516 of the curved panel 502 that extends over the elongated rib 572 and the head 574 of the first engagement feature 368. Thus, the first engagement feature 568 extends along the entire height H (shown in FIG. 12A) of the curved panel 502, but the elongated rib 572 and head 574 do not extend along the entire height H. Instead, the elongated rib 572 and head 574 extend from a bottom facing side of the top wall 584 to a top facing side of the bottom wall 586 of the first engagement feature 568.

To accommodate the top wall 584 and the bottom wall 586 of the first engagement feature 568, the second engagement feature 570 includes a top gap 588 and a bottom gap 590. Thus, the latching walls 576 do not extend along the entire height H of the curved panel 502. Instead, the latching walls 576 extend as long as the elongated rib 572 such that, when the head 574 of the first engagement feature 568 is received between the inwardly facing flat surfaces 580 of the second engagement feature 570 of an adjacent curved panel 502, the top wall 584 fits into the top gap 588 and the bottom wall 586 fits into the bottom gap 590.

FIG. 12D depicts a top view of a second end 532 of a first curved panel 502*a* and a first end 528 of an adjacent second curved panel 502*b* to illustrate how the first and second engagement features 568, 570 of the curved panels 502*a*, 502*b* matingly fit together. The elongated rib 572 and the head 574 are not visible in FIG. 12D because the top wall 584 extends over them. However, the elongated rib 572 and the head 574 are indicated with dashed lines. Additionally, the top gap 588 is not visible in FIG. 12D because the top view does not indicate a difference in height between the top surface 512 and the tops of the latching walls 576.

Figures 13A, 13B, 13C, 13D:
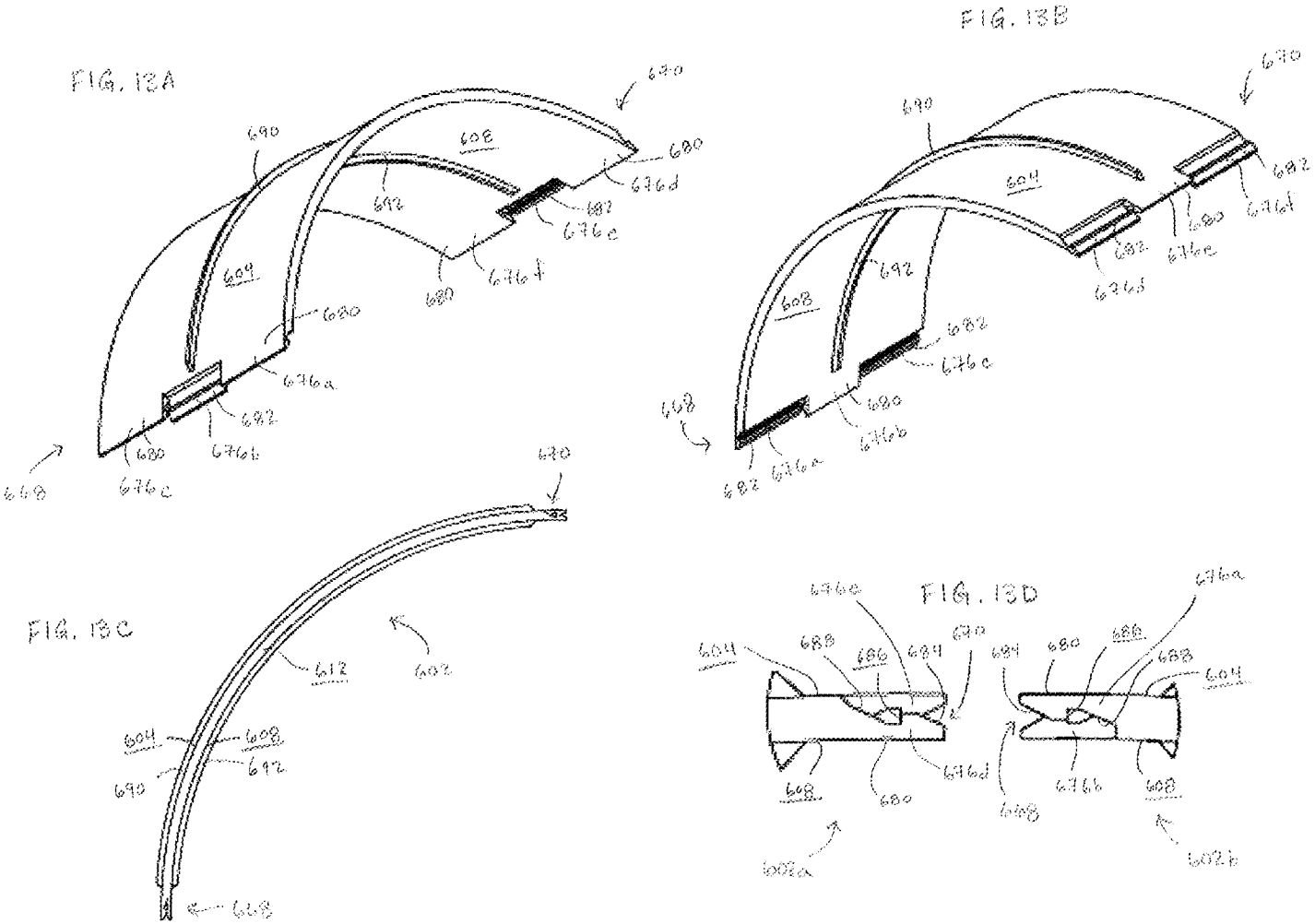
FIG. 13A depicts a top, side perspective view of another alternative embodiment of the apparatus of FIG. 2.
FIG. 13B depicts a bottom, side perspective view of the embodiment of FIG. 13A.
FIG. 13C depicts a top plan view of the embodiment of FIG. 13A.
FIG. 13D depicts a top plan view of a first portion and a second portion of the embodiment of FIG. 13A.

FIGS. 13A-13D depict a curved panel 602 of another alternative embodiment of the apparatus 600. The apparatus 600 is similar to the apparatus 500 and, as shown in FIG. 13C, each curved panel 602 subtends an angle of approximately 90°. Like the curved panels 502, the curved panel 602 has a first engagement feature 668 on a first end 628 and a second engagement feature 670 on a second end 632 of the curved panel 602. The first and second engagement features 668, 670 function in a manner substantially similar to that described above with respect to the first and second engagement features 568, 570 of the curved panel 502. However, each of the first and second engagement features 668, 670 of the curved panel 602 includes opposite facing latching walls 676.

As shown in FIGS. 13A and 13B, the first engagement feature 668 includes latching walls 676*a*, 676*b*, and 676*c*, and the second engagement feature 670 includes latching walls 676*d*, 676*e*, and 676*f*. Each of the latching walls 676*a* and 676*c* of the first engagement feature 668 and 676*e* of the second engagement feature 670 includes a smooth side 680, which extends from the convex surface 604 of the curved panel 602, and a latching side 682, which is opposite the smooth side 680 and faces in the same direction as the concave surface 608 of the curved panel 602.

Conversely, each of the latching walls 676*b* of the first engagement feature 668 and 676*d* and 676*f* of the second engagement feature 670 includes a smooth side 680, which extends from the concave surface 608 of the curved panel 602, and a latching side 682, which is opposite the smooth side 680 and faces in the same direction as the convex surface 604 of the curved panel 602.

The smooth sides 680 of the latching walls 676*a*, 676*c*, 676*d*, and 676*f* and the latching sides 682 of the latching walls 676*b* and 676*e* are visible in FIG. 13A, and the smooth sides 680 of the latching walls 676*b* and 676*e* and the latching sides 682 of the latching walls 676*a*, 676*c*, 676*d*, and 676*f* are visible in FIG. 13B.

The latching side 682 of each of the latching walls 676 includes an angled head 684, a catching surface 686, and a receiver 688. On each of the latching sides 682, the receiver 688 is arranged most proximally, or nearest to the remainder of the curved panel 602, the angled head 684 is arranged most distally, or farthest from the remainder of the curved panel 602, and the angled head 684 is separated from the receiver 688 by the catching surface 686. The catching surface 686 is arranged substantially perpendicular to the convex and concave surfaces 604, 608 of the curved panel 602.

FIG. 13D depicts a top view of a second engagement feature 670 of a first curved panel 602*b* and a first engagement feature 668 of an adjacent second curved panel 602*b*. Because it is a top view, the latching walls 676*d* and 676*e* of the second engagement feature 670 are visible, but the latching wall 676*f* is obscured by latching wall 676*d*. Similarly, latching walls 676*a* and 676*b* of the first engagement feature 668 are visible, but the latching wall 676*c* is obscured by latching wall 676*a*.

When the second engagement feature 670 and the first engagement feature 668 are matingly fitted together, the latching wall 676*a* of the first engagement feature 668 matingly fits together with the latching wall 676*d* of the second engagement feature 670, the latching wall 676*b* matingly fits together with the latching wall 676*e*, and the latching wall 676*c* matingly fits together with the latching wall 676*f*. In particular, with reference to the latching walls 676*a* and 676*d*, as the second engagement feature 670 and the first engagement feature 668 are brought together, the angled head 684 of the latching wall 676*a* contacts the angled head 684 of the latching wall 676*d*, and the angled heads 684 slide along one another. The latching walls 676 are made of an elastic, semi-flexible material such that, as the angled heads 684 slide along one another, the latching walls 676 flex slightly. Once the angled heads 684 slide past the catching surfaces 686, the latching walls 676 return to their original positions, and each angled head 684 is received in the receiver 688 of the opposite latching wall 676 and the catching surfaces 686 are in contact with one another and/or are parallel to one another. The latching walls 676*b* and 676*e* and the latching walls 676*c* and 676*f* are matingly fitted together in the same manner.

When the first and second engagement features 668, 670 of two adjacent curved panels 602*a*, 602*b* are matingly fitted together, the smooth sides 680 of the latching walls 676 are continuous with one another such that the convex surfaces 604 of adjacent curved panels 602*a*, 602*b* are continuous with each other and the concave surfaces 608 of adjacent curved panels 602*a*, 602*b* are continuous with each other.

As shown in FIG. 13C, the curved panel 602 also includes a convex rib 690 formed on the convex surface 604 of the curved panel 602 and a concave rib 692 formed on the concave surface 608 of the curved panel 602. The convex rib 690 is substantially similar to the rib 378 of the curved panel 302 shown in FIGS. 10A-10C and described above. The concave rib 692 is substantially similar to the convex rib 690, but is formed on the opposite side of the curved panel 602.

FIG. 14A-14D depicts further alternative embodiments of curved panels 702 of an apparatus 700. Like the curved panel 602, each of the curved panels 702 has a convex surface 704, a concave surface 708, a top surface 712, and a bottom surface 716, and subtends an angle of approximately 90°. However, unlike the curved panel 602, in the embodiment shown, the curved panels 702 do not include engagement features or ribs. In alternative embodiments, it is possible to configure the curved panels 702 to include either or both of these features.

Each of the curved panels 702 has a height H extending from the top surface 712 to the bottom surface 716. In the embodiment shown in FIG. 14B, the height H is smaller than that of the embodiment shown in FIG. 14C. Further, in the embodiment shown in FIG. 14C, the height H is smaller than that of the embodiment shown in FIG. 14D. The different heights of the curved panels 702 in FIGS. 14B-14D are configured to match standard thicknesses of poured concrete such that the top surface 712 is flush with the top of the concrete and the bottom surface 716 is flush with the bottom of the concrete. As noted above, typical thicknesses of concrete slabs include approximately 3.5 inches, approximately 5.5 inches, and approximately 7.5 inches. Accordingly, the height H of the curved panel 702 can be, for example, approximately 3.5 inches in the embodiment shown in FIG. 14B, approximately 5.5 inches in the embodiment shown in FIG. 14C, or approximately 7.5 inches in the embodiment shown in FIG. 14D to correspond to the height of the concrete slab 26.

Each of the curved panels 702 has a top vertical portion 780 adjacent to the top surface 712, a bottom vertical portion 782 adjacent to the bottom surface 716, and a middle vertical portion 784 arranged between the top and bottom vertical portions 780, 782. Each of the curved panels 702 further includes a top curved portion 786 extending between the top vertical portion 780 and the middle vertical portion 784 and a bottom curved portion 788 extending between the bottom vertical portion 782 and the middle vertical portion 784.

The top and bottom vertical portions 780, 782 are substantially parallel and coplanar with one another, and the middle vertical portion 784 is offset from, but is still substantially parallel to, the top and bottom vertical portions 780, 782. The top and bottom curved portions 786, 788 and the offset of the middle vertical portion 784 provide additional surface area for the poured concrete to contact and integrate with the convex and concave surfaces 704, 708 of the curved panel 702.

As can be seen by comparing the curved panels 702 shown in FIGS. 14B-14D, the heights H of the curved panels 702 are varied by varying the heights of the top, bottom, and vertical portions 780, 782, 784. However, the top view of the curved panel 702 shown in FIG. 14A is the same for each of the curved panels 702 shown in FIGS. 14B-14D.

The present disclosure should be considered as illustrative and not restrictive in character. It is understood that only certain embodiments have been presented and that all changes, modifications, and further applications that come within the spirit of the disclosure are desired to be protected.

What is claimed is:

1. An apparatus for reducing propagation of cracks in concrete, the apparatus comprising:

at least one curved panel, including:

a convex surface and a concave surface facing away from one another and separated by a thickness, each of the convex surface and the concave surface having a top edge and a bottom edge opposite the top edge, each of the convex surface and the concave surface configured to be arranged in direct contact with the concrete;

a top surface extending from the top edge of the convex surface to the top edge of the concave surface, the top surface being substantially planar and substantially perpendicular to the convex surface and the concave surface;

a bottom surface extending from the bottom edge of the convex surface to the bottom edge of the concave surface, the bottom surface being substantially planar and substantially parallel to the top surface; and at least one rib extending outwardly from the convex surface; and an expansion collar configured to fit substantially concentrically around the convex surface of the at least one curved panel, the expansion collar including at least one notch configured to matingly receive the at least one rib of the at least one curved panel.

2. The apparatus of claim 1, wherein:

the at least one curved panel forms a circular arc.

3. The apparatus of claim 2, wherein:

the circular arc subtends an angle of approximately 252°.

4. The apparatus of claim 2, wherein:

the circular arc has a radius; and the radius is between approximately 6 inches and approximately 12.25 inches long.

5. The apparatus of claim 1, wherein:

the at least one curved panel has a height extending from the top surface to the bottom surface; and the height is between approximately 3.5 inches and approximately 7.5 inches.

6. The apparatus of claim 1, wherein:

the at least one curved panel is a plurality of curved panels; and a first end of a first curved panel of the plurality of curved panels includes an engagement feature configured to matingly engage with a corresponding engagement feature on a second end of a second curved panel of the plurality of curved panels.

7. The apparatus of claim 6, wherein:

each curved panel of the plurality of curved panels forms a circular arc.

8. The apparatus of claim 7, wherein:

the circular arc of each curved panel of the plurality of curved panels subtends an angle of approximately 90°.

9. The apparatus of claim 1, further comprising:

at least one retention feature formed on at least one of the convex surface and the concave surface such that the at least one retention feature projects in a direction substantially parallel with the top surface and the bottom surface.

* * * * *